US010049619B2

(12) United States Patent
Choi et al.

(10) Patent No.: US 10,049,619 B2
(45) Date of Patent: Aug. 14, 2018

(54) DISPLAY DEVICE AND METHOD OF DRIVING THE SAME

(71) Applicant: SAMSUNG DISPLAY CO., LTD., Yongin, Gyeonggi-do (KR)

(72) Inventors: Geun Hyuk Choi, Yongin-si (KR); Sang Hyun Lee, Yongin-si (KR); Hyo Chul Lee, Yongin-si (KR); Jae Ho Choi, Yongin-si (KR); Hyun Seok Hong, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 105 days.

(21) Appl. No.: 15/342,530

(22) Filed: Nov. 3, 2016

(65) Prior Publication Data

US 2017/0162123 A1 Jun. 8, 2017

(30) Foreign Application Priority Data

Dec. 2, 2015 (KR) ..... 10-2015-0170708

(51) Int. Cl.
*G09G 3/36* (2006.01)
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2310/0286* (2013.01); *G09G 2310/08* (2013.01)

(58) Field of Classification Search
CPC ..... G09G 3/3266–3/3291
See application file for complete search history.

(56) References Cited

U.S. PATENT DOCUMENTS

| | | | | |
|---|---|---|---|---|
| 7,466,312 | B2 | 12/2008 | Choi et al. | |
| 2008/0117157 | A1* | 5/2008 | Hwang | G09G 3/3611 345/92 |
| 2008/0278467 | A1* | 11/2008 | Hwang | G09G 3/3648 345/205 |
| 2010/0220079 | A1* | 9/2010 | Bang | G09G 3/3648 345/204 |
| 2013/0201174 | A1* | 8/2013 | Pyun | G09G 3/3607 345/213 |
| 2014/0016240 | A1* | 1/2014 | Kawata | H02H 3/0935 361/95 |
| 2015/0194800 | A1* | 7/2015 | Kim | G09G 3/3677 361/95 |

* cited by examiner

*Primary Examiner* — Sanghyuk Park
(74) *Attorney, Agent, or Firm* — Cantor Colburn LLP

(57) ABSTRACT

A display device includes a timing controller which transmits a vertical clock signal having rising edges and falling edges to a gate driver and a gate driver which receives the vertical clock signal, to generate a first gate clock signal and a first inverted gate clock signal in accordance with one of the rising edges and the falling edges of the vertical clock signal, and to generate a second gate clock signal and a second inverted gate clock signal in accordance with a remaining one of the rising edges and the falling edges of the vertical clock signal.

15 Claims, 5 Drawing Sheets

DISPLAY DEVICE AND METHOD OF DRIVING THE SAME

This application claims priority to Korean Patent Application No. 10-2015-0170708, filed on Dec. 2, 2015, and all the benefits accruing therefrom under 35 U.S.C. § 119, the content of which in its entirety is herein incorporated by reference.

BACKGROUND

1. Field

Exemplary embodiments of the invention relate to a display device and a method of driving the same.

2. Description of the Related Art

A display device is included in various electronic devices such as a computer monitor, a television ("TV") set, and a mobile phone that are recently widely used. The display device that displays images using digital data include a cathode ray tube ("CRT") display device, a liquid crystal display ("LCD"), a plasma display panel ("PDP"), and an organic light emitting display device ("OLED"), for example.

The display device generally includes a display panel including a display unit and a panel driver for driving the display panel. The display panel includes a plurality of gate lines and a plurality of data lines. The panel driver may include a gate driver for providing gate signals to the plurality of gate lines and a data driver for providing data voltages to the data lines.

The gate driver may be integrated with the display panel, and the gate driver integrated with the display panel may be referred to as an amorphous silicon gate ("ASG").

SUMMARY

An exemplary embodiment of the invention relates to a display device capable of reducing the number of pins between a timing controller and a gate driver and a method of driving the same.

Another exemplary embodiment of the invention relates to a display device capable of reducing wiring lines in a display panel to additionally secure a wiring line space and a method of driving the same.

Objects of the invention are not limited to the above and other objects that are not mentioned may be clearly understood to those skilled in the art from the following.

A display device according to an exemplary embodiment of the invention includes a timing controller which transmits a vertical clock signal having rising edges and falling edges to a gate driver and a gate driver which receives the vertical clock signal, generates a first gate clock signal and a first inverted gate clock signal in accordance with one of the rising edges and the falling edges of the vertical clock signal, and generates a second gate clock signal and a second inverted gate clock signal in accordance with a remaining one of the rising edges and the falling edges of the vertical clock signal.

In an exemplary embodiment, the display device may further include a display panel including a plurality of pixels. In an exemplary embodiment, the gate driver may be combined with the display panel in a form of an amorphous silicon gate ("ASG").

In an exemplary embodiment, the first gate clock signal and the first inverted gate clock signal may have opposite phases and the second gate clock signal and the second inverted gate clock signal may have opposite phases.

In an exemplary embodiment, the gate driver may reduce a voltage level of the first gate clock signal to a lower level and increases a voltage level of the first inverted gate clock signal to a higher level at a first rising edge of the vertical clock signal and increases the voltage level of the first gate clock signal to a higher level and reduces the voltage level of the first inverted gate clock signal to a lower level at a second rising edge of the vertical clock signal.

In an exemplary embodiment, the gate driver may reduce a voltage level of the second gate clock signal to a lower level and increases a voltage level of the second inverted gate clock signal to a higher level at a first falling edge of the vertical clock signal and increases the voltage level of the second gate clock signal to a higher level and reduces the voltage level of the second inverted gate clock signal to a lower level at a second falling edge of the vertical clock signal.

In an exemplary embodiment, the data driver may reduce the voltage level of the first gate clock signal or the voltage level of the second gate clock signal to an intermediate level at the first rising edge of the vertical clock signal, reduces the voltage level of the first gate clocks signal or the voltage level of the second gate clock signal to a low level after a predetermined first intermediate period, increases the voltage level of the first inverted gate clock signal or the voltage level of the second inverted gate clock signal to an intermediate level at the first rising edge, and increases the voltage level of the first inverted gate clock signal or the voltage level of the second inverted gate clock signal to a high level after the first intermediate period.

In an exemplary embodiment, the data driver may increase the voltage level of the first gate clock signal or the voltage level of the second gate clock signal to an intermediate level at the second rising edge of the vertical clock signal, increases the voltage level of the first gate clocks signal or the voltage level of the second gate clock signal to a high level after a predetermined second intermediate period, reduces the voltage level of the first inverted gate clock signal or the voltage level of the second inverted gate clock signal to an intermediate level at the second rising edge, and reduces the voltage level of the first inverted gate clock signal or the voltage level of the second inverted gate clock signal to a low level after the second intermediate period.

In an exemplary embodiment, the gate driver may include an output end of the first gate clock signal and an output end of the first inverted gate clock signal shorted to perform charge share operation in one of a first intermediate period and a second intermediate period.

A method of driving a display device according to an exemplary embodiment of the invention includes generating a vertical clock signal having rising edges and falling edges and generating a first gate clock signal and a first inverted gate clock signal in accordance with one of the rising edges and the falling edges of the vertical clock signal and generating a second gate clock signal and a second inverted gate clock signal in accordance with a remaining one of the rising edges and the falling edges of the vertical clock signal.

According to an exemplary embodiment of the invention, it is possible to provide a display device capable of reducing the number of pins between a timing controller and a gate driver and a method of driving the same.

In addition, according to an exemplary embodiment of the invention, it is possible to provide a display device capable of reducing wiring lines in a display panel to additionally secure a wiring line space and a method of driving the same.

Effects of the invention are not limited to the above and other effects that are not mentioned may be clearly understood to those skilled in the art from the following.

BRIEF DESCRIPTION OF THE DRAWINGS

Exemplary embodiments will now be described more fully hereinafter with reference to the accompanying drawings; however, they may be embodied in different forms and should not be construed as limited to the embodiments set forth herein. Rather, these embodiments are provided so that this invention will be thorough and complete, and will full convey the scope of the exemplary embodiments to those skilled in the art.

DETAILED DESCRIPTION

Figure 1:
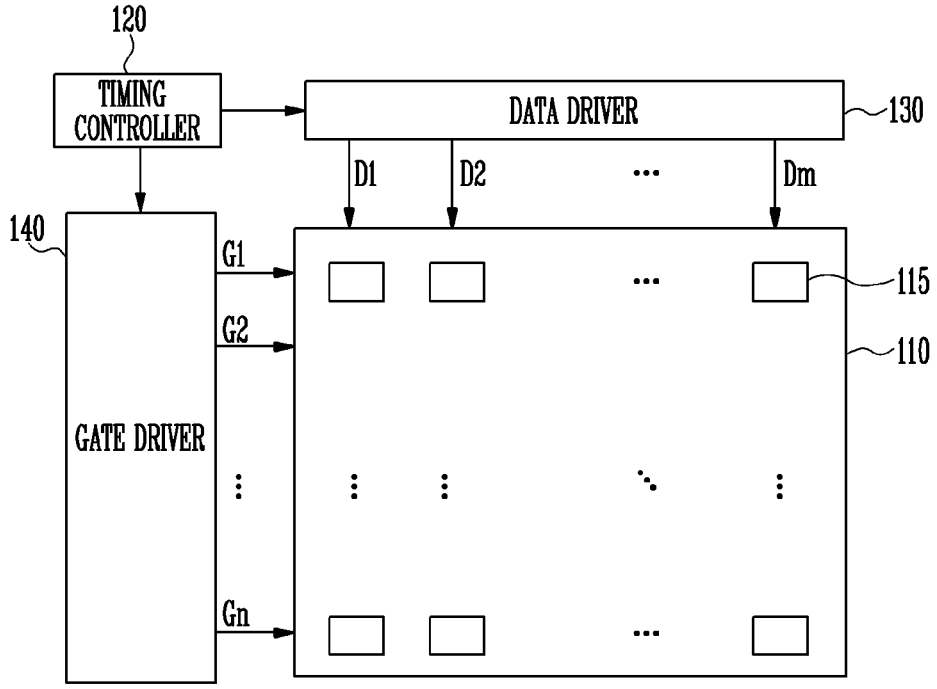
FIG. 1 is a block diagram of an exemplary embodiment of a display device according to the invention.

Hereinafter, embodiments of the invention will be described in detail with reference to the accompanying drawings.

In describing the invention, when an exemplary embodiment has been well known in the art to which the invention pertains and technical contents is not directly related to an exemplary embodiment of the invention, descriptions thereof will be omitted. This is to allow the exemplary embodiment of the invention to be clearly understood without obscuring the gist of the exemplary embodiment of the invention.

It is to be understood that when one element is referred to as being "connected to" or "coupled to" another element, it may be connected directly to or coupled directly to another element or be connected to or coupled to another element, having the other element intervening therebetween. In addition, in the following description, and the word 'including' does not preclude the presence of other components and means that an additional component is included in the technical concept of the invention.

Terms such as 'first', 'second', etc., may be used to describe various components, but the components are not to be construed as being limited to the terms. The terms are used only to distinguish one component from another component. For example, the 'first' component may be named the 'second' component and the 'second' component may also be similarly named the 'first' component, without departing from the scope of the invention.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Also, elements of the embodiments of the invention are independently illustrated to show different characteristic functions, and it does not mean that each element is configured as separated hardware or a single software component. Namely, for the sake of explanation, respective elements are arranged to be included, and at least two of the respective elements may be incorporated into a single element or a single element may be divided into a plurality of elements to perform a function, and the integrated embodiment and divided embodiment of the respective elements are included in the scope of the invention unless it diverts from the essence of the invention.

Also, some of the elements may be optional to merely enhance the performance, rather than being essential to perform a constitutional function. The invention may be implemented using only the elements requisite for implement the essence of the invention, excluding elements used to merely enhance the performance, and a structure including only the essential elements excluding the optional elements merely used to enhance the performance is also included in the scope of the invention.

In describing embodiments of the invention, a detailed description of known techniques associated with the invention unnecessarily obscures the gist of the invention, it is determined that the detailed description thereof will be omitted. Moreover, the terms used henceforth have been defined in consideration of the functions of the invention, and may be altered according to the intent of a user or operator, or conventional practice. Therefore, the terms should be defined on the basis of the entire content of this specification.

FIG. 1 is a block diagram of a display device according to an exemplary embodiment of the invention.

Referring to FIG. 1, the display device according to the exemplary embodiment of the invention may include a display panel 110 including a plurality of pixels 115, a gate driver 140 for transmitting a plurality of gate signals to the display panel 110, a data driver 130 for transmitting a plurality of data signals to the display panel 110, and a timing controller 120 for controlling the gate driver 140 and the data driver 150.

In the display panel 110, the plurality of pixels 115 are arranged in a matrix. The pixels 115 may respectively emit light corresponding to flows of driving currents in accordance with the data signals transmitted from the data driver 130. In an exemplary embodiment, the pixels 115 may include light emitting elements such as organic light emitting diodes ("OLED"). In an exemplary embodiment, according to a method of driving the OLEDs, the display device may be divided into a passive matrix organic light emitting display device ("PMOLED") and an active matrix OLED ("AMOLED"). In the illustrated exemplary embodiment, the display device may be the AMOLED, for example.

A plurality of gate lines G1 to Gn extending in a row direction to transmit the gate signals from the gate driver 140, and a plurality of data lines D1 to Dm extending in a column direction to transmit the data signals from the data driver 130 are respectively arranged in the plurality of pixels 115 included in the display unit 110 where n and m are natural numbers greater than 1.

That is, among the plurality of pixels 115, the pixel 115 positioned in a jth pixel row and a kth pixel column may be connected to a corresponding gate line Gj and a corresponding data line Dk where j is a natural number equal to or greater than 1 and equal to or less than n and k is a natural number equal to or greater than 1 and equal to or less than m. However, the invention is not limited thereto. In an exemplary embodiment, the gate driver 140 may be implemented by a plurality of drivers, for example.

Each of the pixels 115 includes a pixel circuit for supplying a current in accordance with a corresponding data signal to an OLED and the OLED may emit light with predetermined brightness in accordance with the supplied current. In an exemplary embodiment, the first power source voltage and the second power source voltage that are required for the operation of the display unit 110 may be transmitted from a power source supplying unit (not shown).

The gate driver 140 for applying the plurality of gate signals to the display unit 110 are connected to the plurality of gate lines G1 to Gn and may respectively transmit the plurality of gate signals to corresponding gate lines among the plurality of gate lines G1 to Gn. The gate driver 140 generates the gate signals and may transmit the generated gate signals to the gate lines connected to the rows of the plurality of pixels 115 included in the display unit 110 in accordance with a gate driving control signal supplied from the timing controller 120. When the gate signals are supplied to the gate lines G1 to Gn, the pixels 115 are selected. Here, the gate driver 140 may simultaneously or sequentially supply the gate signals to the gate lines G1 to Gn in response to a driving method.

The data driver 130 generates the plurality of data signals from an image data signal transmitted from the timing controller 120 and may transmit the generated data signals to the plurality of data lines D1 to Dm connected to the display unit 110. The data driver 130 may be driven by a data driving control signal supplied by the timing controller 120.

The timing controller 120 may receive timing signals such as a horizontal synchronizing signal, a vertical synchronizing signal, a data enable signal, and a dot clock. Control signals to be respectively transmitted to the data driver 130 and the gate driver 140 may be generated using the received signals. In addition, the timing controller 120 receives data (not shown) from the outside and may supply the received data to the data driver 130.

The gate driver 140 may be combined (e.g., integrated) with the display panel 110 together with the gate lines G1 to Gn and the data lines D1 to Dm. That is, in an exemplary embodiment, the gate driver 140 may be an amorphous silicon gate ("ASG") combined with the display panel 110.

In addition, according to an exemplary embodiment, the gate driver 140 may be included in a power management integrated circuit ("PMIC") (not shown).

According to an exemplary embodiment, the gate driver 140, the data driver 130, and the timing controller 120 may be implemented in one display driver IC as hardware.

The plurality of pixels 115 included in the display panel 110 receives corresponding gate signals so that the OLEDs emit light by data voltages corresponding to the data signals, and thereby an image may be displayed.

Figure 2:
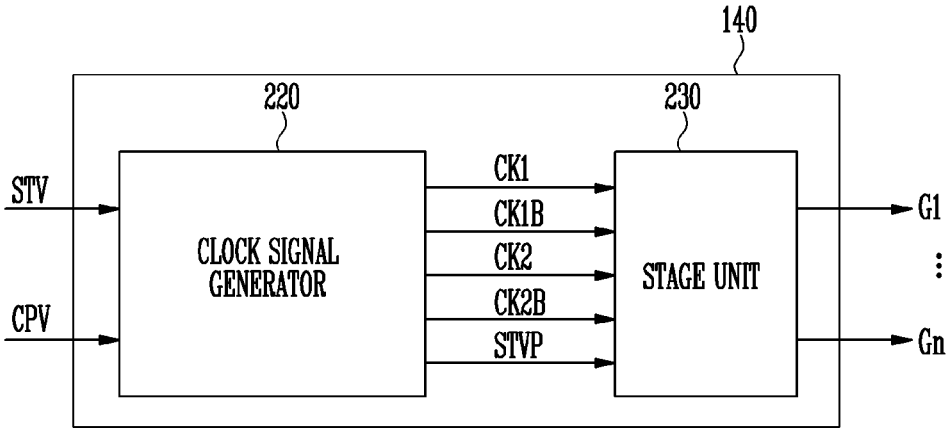
FIG. 2 is a block diagram of an exemplary embodiment of a gate driver of a display device according to the invention.
Figure 3:
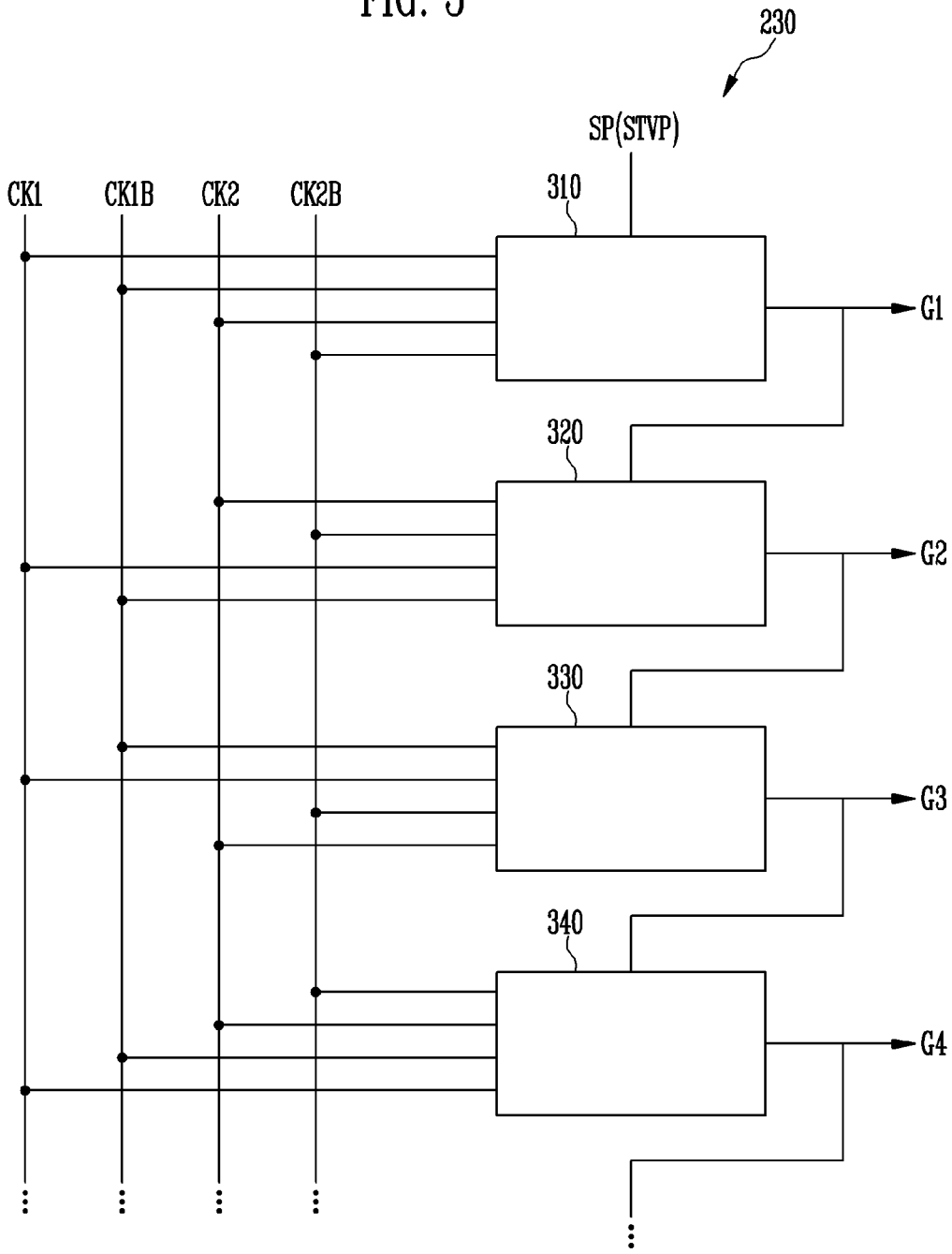
FIG. 3 is a block diagram of an exemplary embodiment of a gate driver of a display device according to the invention.

FIG. 2 is a block diagram of a gate driver of a display device according to an exemplary embodiment of the invention. FIG. 3 is a block diagram of a gate driver of a display device according to an exemplary embodiment of the invention.

Referring to FIGS. 1 and 2, the gate driver 140 of the display device according to the exemplary embodiment of the invention may include a clock signal generator 220 and a stage unit 230.

The clock signal generator 220 may receive a vertical synchronizing start signal STV and a vertical clock signal CPV from the timing controller 120. Then, the clock signal generator 220 generates a vertical start signal STVP using the received vertical synchronizing start signal STV and may generate a first gate clock signal CK1, a first inverted gate clock signal CK1B, a second gate clock signal CK2, and a second inverted gate clock signal CK2B using the vertical clock signal CPV.

Then, the clock signal generator 220 may output the vertical start signal STVP, the first gate clock signal CK1, the first inverted gate clock signal CK1B, the second gate clock signal CK2, and the second inverted gate clock signal CK2B to the stage unit 230.

The stage unit 230 generates the gate signals using the vertical start signal STVP, the first gate clock signal CK1, the first inverted gate clock signal CK1B, the second gate clock signal CK2, and the second inverted gate clock signal CK2B and may supply the generated gate signals to the corresponding gate lines G1 to Gn.

Then, referring to FIG. 3, the stage unit 230 of the gate driver 140 of the display device according to the exemplary embodiment of the invention may include a plurality of stages 310, 320, 330, and 340. In the illustrated exemplary embodiment in FIG. 3, for convenience sake, the four stages 310, 320, 330, and 340 are illustrated. However, the invention is not limited thereto, and the stage unit 230 may include a different number of stages. The stages may be also referred to as shift registers.

The stages 310, 320, 330, and 340 are respectively connected to corresponding gate lines G1, G2, G3, and G4 and may be driven by the four clock signals CK1, CK1B, CK2, and CK2B and a start pulse SP. In an exemplary embodiment, the start pulse SP may be the vertical start signal STVP.

The first stage 310 receives the start pulse SP and may receive the first gate clock signal CK1, the first inverted gate clock signal CK1B, the second gate clock signal CK2, and the second inverted gate clock signal CK2B. Then, the first stage 310 may output a first gate signal to the first gate line G1 using the received gate clock signals CK1, CK1B, CK2, and CK2B.

The second stage 320 receives the first gate signal output from the first stage 310 as the start pulse SP and may receive the second gate clock signal CK2, the second inverted gate clock signal CK2B, the first gate clock signal CK1, and the first inverted gate clock signal CK1B. Then, the second stage 320 may output a second gate signal to the second gate line G2 using the received gate clock signals CK1, CK1B, CK2, and CK2B.

The third stage 330 receives the second gate signal output from the second stage 320 as the start pulse SP and may receive the first inverted gate clock signal CK1B, the first gate clock signal CK1, the second inverted gate clock signal CK2B, and the second gate clock signal CK2. Then, the third stage 330 may output a third gate signal to the third gate line G3 using the received gate clock signals CK1, CK1B, CK2, and CK2B.

The fourth stage 340 receives a third gate signal output from the third stage 330 and may receive the second inverted gate clock signal CK2B, the second gate clock signal CK2, the first inverted gate clock signal CK1B, and the first gate clock signal CK1. Then, the fourth stage 340 may output a fourth gate signal to the fourth gate line G4 using the received gate clock signals CK1, CK1B, CK2, and CK2B.

Figure 4:
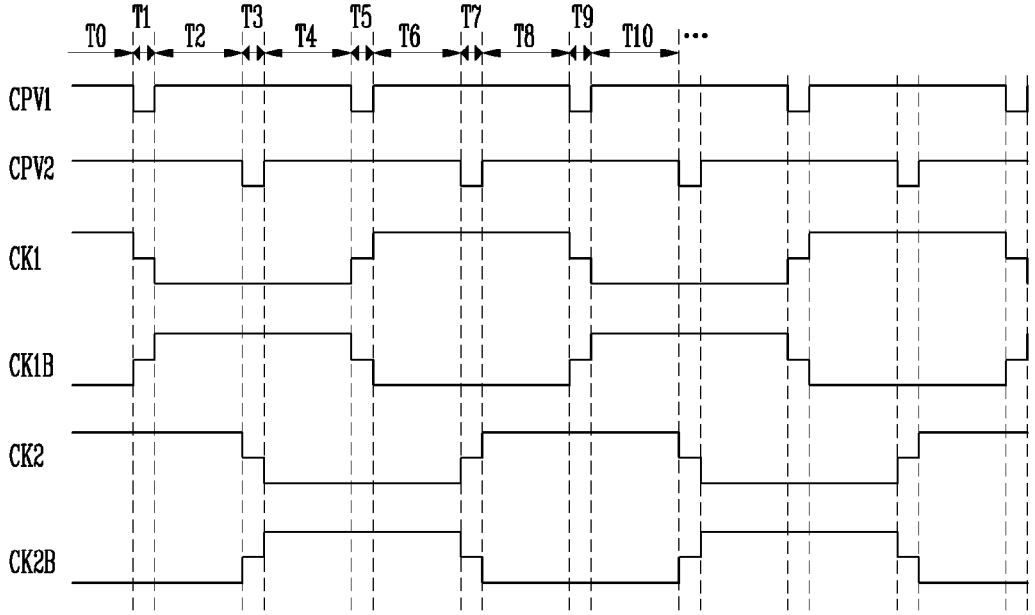
FIG. 4 (Prior Art)
FIG. 4 is a view illustrating generated waveforms of conventional gate clock signals.

FIG. 4 is a view illustrating an example of generated waveforms of conventional gate clock signals.

Referring to FIG. 4, the gate driver 140 may generate the first gate clock signal CK1 and the first inverted gate clock signal CK1B using a first vertical clock signal CPV1. Then, the gate driver 140 may generate the second gate clock signal CK2 and the second inverted gate clock signal CK2B using a second vertical clock signal CPV2.

In an exemplary embodiment, as illustrated in FIG. 4, the first vertical clock signal CPV1 may have high periods T0, T2, T3, T4, T6, T7, T8, and T10 and low periods T1, T5, and T9, for example. In an exemplary embodiment, in the $0^{th}$ high period T0 of the first vertical clock signal CPV1, the first gate clock signal CK1 may be at a high level. Then, the first gate clock signal CK1 is reduced to an intermediate level in the first low period T1 of the first vertical clock signal CPV1 and may be reduced to a low level in the first high periods T2, T3, and T4 of the first vertical clock signal CPV1. Then, the first gate clock signal CK1 is increased to an intermediate level in the second low period T5 of the first vertical clock signal CPV1 and may be increased to a high level in the second high periods T6, T7, and T8 of the first vertical clock signal CPV1.

The first inverted gate clock signal CK1B has a phase opposite to that of the first gate clock signal CK1. That is, in the $0^{th}$ high period T0 of the first vertical clock signal CPV1, the first inverted gate clock signal CK1B may be at a low level. Then, the first inverted gate clock signal CK1B may be increased to an intermediate level in the first low period T1 of the first vertical clock signal CPV1 and may be increased to a high level in the first high periods T2, T3, and T4 of the first vertical clock signal CPV1. Then, the first inverted gate clock signal CK1B is reduced to an intermediate level in the second low period T5 of the first vertical clock signal CPV1 and may be reduced to a low level in the second high periods T6, T7, and T8 of the first vertical clock signal CPV1.

In an exemplary embodiment, in the low periods T1, T5, and T9 of the first vertical clock signal CPV1, charge share operation may be performed on the first gate clock signal CK1 and the first inverted gate clock signal CK1B. In an exemplary embodiment, a first switch may be provided between an output end of the first gate clock signal CK1 and an output end of the first inverted gate clock signal CK1B, for example. In an exemplary embodiment, in the first low period T1 of the first vertical clock signal CPV1, the first switch is turned on so that the output end of the first gate clock signal CK1 and the output end of the first inverted gate clock signal CK1B may be shorted. Therefore, in the first low period T1, the intermediate level of the first gate clock signal CK1 and the intermediate level of the first inverted gate clock signal CK1B may have the same value. In the second low period T5 of the first vertical clock signal CPV1, the first switch is also turned on so that the output end of the first gate clock signal CK1 and the output end of the first inverted gate clock signal CK1B may be shorted.

In addition, as illustrated in FIG. 4, the second vertical clock signal CPV2 may have high periods T0, T1, T4, T5, T6, T8, T9, and T10 and low periods T3 and T7. In an exemplary embodiment, in the first high periods T0, T1, and T2 of the second vertical clock signal CPV2, the second gate clock signal CK2 may be at a high level. Then, the second gate clock signal CK2 is reduced to an intermediate level in the first low period T3 of the second vertical clock signal CPV2 and may be reduced to a low level in the second high periods T4, T5, and T6 of the second vertical clock signal CPV2. Then, the second gate clock signal CK2 is increased to an intermediate level in the second low period T7 of the second vertical clock signal CPV2 and may be increased to a high level in the third high periods T8, T9, and T10 of the second vertical clock signal CPV2.

Then, the second inverted gate clock signal CK2B has a phase opposite to that of the second gate clock signal CK2. That is, in the first high periods T0, T1, and T2 of the second vertical clock signal CPV2, the second inverted gate clock signal CK2B may be at a low level. Then, the second inverted gate clock signal CK2B is increased to an intermediate level in the first low period T3 of the second vertical clock signal CPV2 and may be increased to a high level in the second high periods T4, T5, and T6 of the second vertical clock signal CPV2. Then, the second inverted gate clock signal CK2B is reduced to an intermediate level in the second low period T7 of the second vertical clock signal CPV2 and may be reduced to a low level in the third high periods T8, T9, and T10 of the second vertical clock signal CPV2.

In an exemplary embodiment, in the low periods T3 and T7 of the second vertical clock signal CPV2, charge share operation may be performed on the second gate clock signal CK2 and the second inverted gate clock signal CK2B. In an exemplary embodiment, a second switch may be provided between an output end of the second gate clock signal CK2 and an output end of the second inverted gate clock signal CK2B, for example. In an exemplary embodiment, in the first low period T3 of the second vertical clock signal CPV2, the second switch is turned on so that the output end of the second gate clock signal CK2 and the output end of the second inverted gate clock signal CK2B may be shorted. Therefore, in the first low period T3 of the second vertical clock signal CPV2, the intermediate level of the second gate clock signal CK2 and the intermediate level of the second inverted gate clock signal CK2B may have the same value. In the second low period T7 of the second vertical clock signal CPV2, the second switch is also turned on so that the output end of the second gate clock signal CK2 and the output end of the second inverted gate clock signal CK2B may be shorted. Therefore, in the second low period T7 of the second vertical clock signal CPV2, the intermediate level of the second gate clock signal CK2 and the intermediate level of the second inverted gate clock signal CK2B may have the same value.

For this purpose, in order to generate the gate clock signals, the timing controller 120 outputs the vertical synchronizing start signal STV from a vertical synchronizing start signal output pin thereof, outputs the first vertical clock signal CPV1 from a first vertical clock signal output pin, and may output the second vertical clock signal CPV2 from a second vertical clock signal output pin.

Then, the vertical synchronizing start signal STV, the first vertical clock signal CPV1, and the second vertical clock signal CPV2 that are output from the timing controller 120 may be input to the gate driver 140. That is, the vertical synchronizing start signal STV is input from a vertical synchronizing start signal input pin of the gate driver 140, the first vertical clock signal CPV1 is input from a first vertical clock signal input pin, and the second vertical clock signal CPV2 may be input to a second vertical clock signal input pin.

Then, the gate driver 140 generates the vertical start signal STVP using the vertical synchronizing start signal STV and may generate the first gate clock signal CK1 and the first inverted gate clock signal CK1B using the first vertical clock signal CPV1. Then, the gate driver 140 may generate the second gate clock signal CK2 and the second inverted gate clock signal CK2B using the second vertical clock signal CPV2. In an exemplary embodiment, the first inverted gate clock signal CK1B may be obtained by inverting the first gate clock signal CK1. The second inverted gate clock signal CK2B may be obtained by inverting the second gate clock signal CK2.

The gate driver 140 may output the generated vertical start signal STVP, first gate clock signal CK1, first inverted gate clock signal CK1B, second gate clock signal CK2, and second inverted gate clock signal CK2B. That is, the vertical start signal STVP may be output from the vertical start signal output pin of the gate driver 140. The first gate clock signal CPV1 is output from the first gate clock signal output pin and the first inverted gate clock signal CK1B may be output from the first inverted gate clock signal output pin. In addition, the second gate clock signal CPV2 is output from the second gate clock signal output pin and the second inverted gate clock signal CK2B may be output from the second inverted gate clock signal output pin In order to drive the display device as described above, the timing controller 120 needs three output pins and the gate driver 140 may need three input pins and five output pins.

As a mobile phone to which the display device is attached becomes small and slim, a wiring line space of a printed circuit board ("PCB") may be insufficient. In a high resolution product, various optional functions may be added to the timing controller 120 so that pins of the timing controller 120 may be insufficient.

In the display device according to the exemplary embodiment of the invention, among the outputs of the timing controller 120, waveforms of the first vertical clock signal CPV1 and the second vertical clock signal CPV2 are made one, the one is output, and the first gate clock signal CK1, the first inverted gate clock signal CK1B, the second gate clock signal CK2, and the second inverted gate clock signal CK2B may be generated using the one vertical clock signal CPV. Therefore, in the timing controller 120 and the gate driver 140, the number of pins is reduced by one and PCB wiring lines may be reduced.

Figure 5:
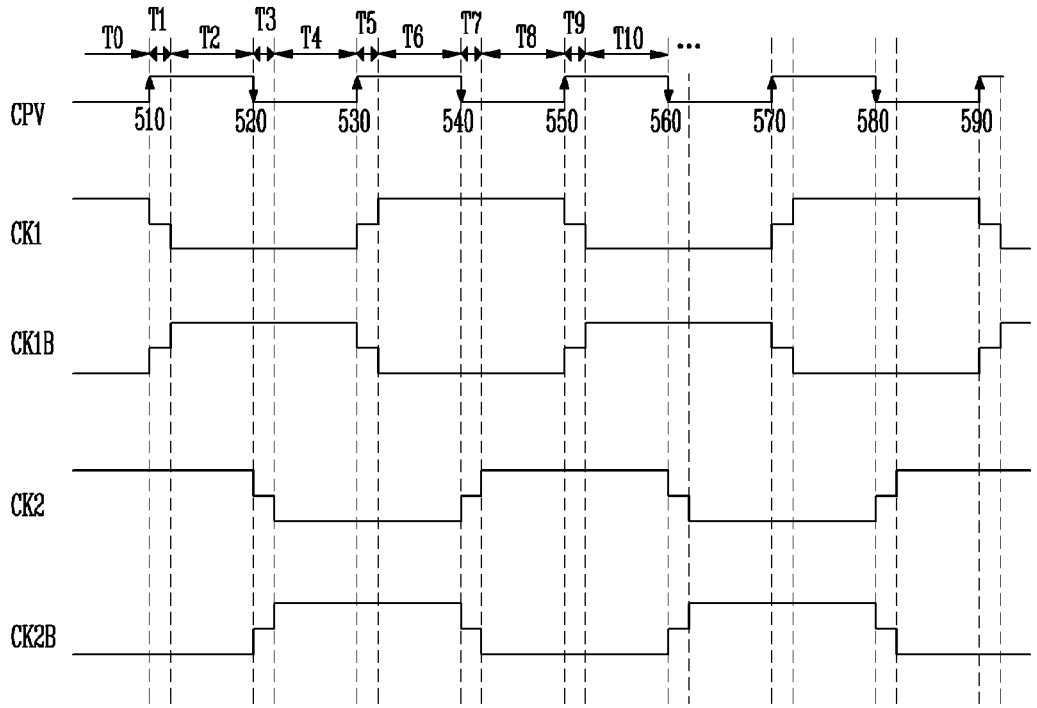
FIG. 5 is a view illustrating an exemplary embodiment of generated waveforms of gate clock signals according to the invention.
Figure 6:
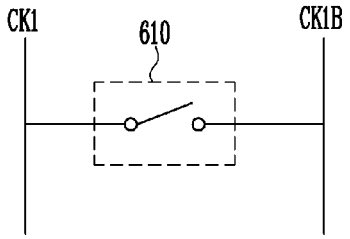
FIG. 6 is a view illustrating an exemplary embodiment of an output end of a first gate clock signal and an output end of a first inverted gate clock signal.
Figure 7:
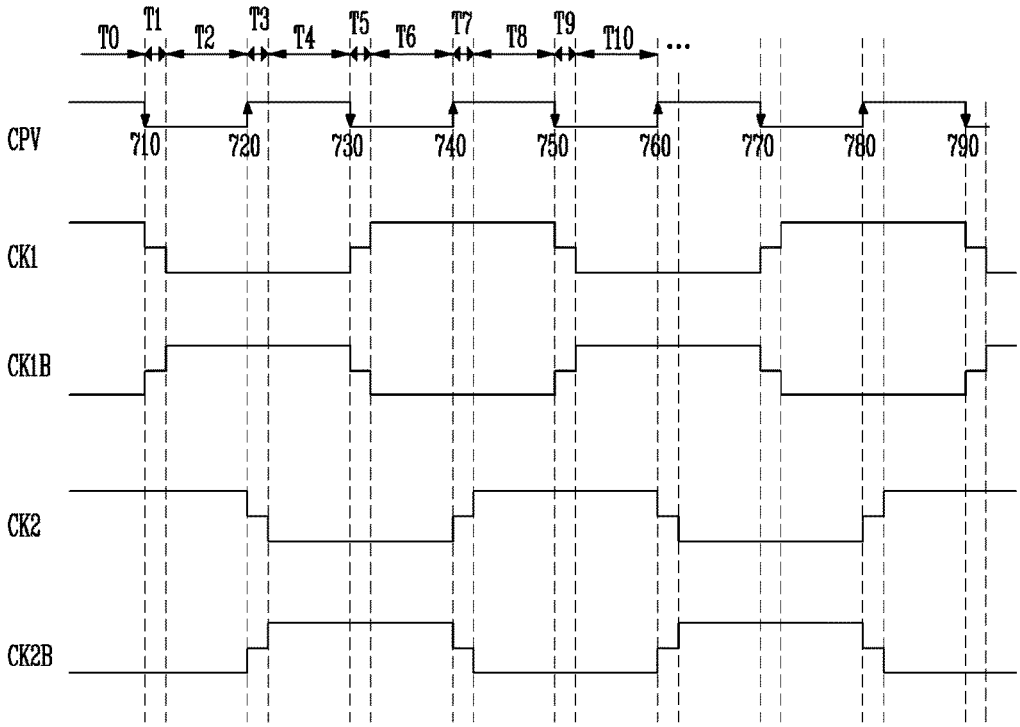
FIG. 7 is a view illustrating another exemplary embodiment of generated waveforms of gate clock signals according to the invention.

FIG. 5 is a view illustrating an example of generated waveforms of gate clock signals according to an exemplary embodiment of the invention. FIG. 6 is a view illustrating an example of an output end of a first gate clock signal and an output end of a first inverted gate clock signal. FIG. 7 is a view illustrating an example of generated waveforms of gate clock signals according to another exemplary embodiment of the invention.

Referring to FIG. 5, the gate driver 140 according to the exemplary embodiment of the invention may generate the first gate clock signal CK1, the first inverted gate clock signal CK1B, the second gate clock signal CK2, and the second inverted gate clock signal CK2B using the one vertical clock signal CPV.

In an exemplary embodiment, as illustrated in FIG. 5, the vertical clock signal CPV may have low periods T0, T3, T4, T7, and T8 and high periods T1, T2, T5, T6, T9, and T10, for example.

In an exemplary embodiment, the gate driver 140 may detect rising edges 510, 530, 550, 570, and 590 of the vertical clock signal CPV. That is, the gate driver 140 may detect the rising edges 510, 530, 550, 570, and 590 at which a voltage level of the vertical clock signal CPV changes from the low periods T0, T3, T4, T7, and T8 of the vertical clock signal CPV to the high periods T1, T2, T5, T6, T9, and T10 of the vertical clock signal CPV. Then, the gate driver 140 may generate the first gate clock signal CK1 and the first inverted gate clock signal CK1B using the rising edges 510, 530, 550, 570, and 590 of the vertical clock signal CPV. In an exemplary embodiment, the first inverted gate clock signal CK1B has a phase opposite to that of the first gate clock signal CK1.

In an exemplary embodiment, in the $0^{th}$ low period T0 of the vertical clock signal CPV, the first gate clock signal CK1 is at a high level and the first inverted gate clock signal CK1B may be at a low level, for example. In an exemplary embodiment, the gate driver 140 may detect the first rising edge 510 at which the vertical clock signal CPV rises from the $0^{th}$ low period T0 to the first high periods T1 and T2. Then, the gate driver 140 reduces the first gate clock signal CK1 to a lower level (e.g., from a high level to an intermediate level) and may increase the first inverted gate clock signal CK1B to a higher level (e.g., from a low level to an intermediate level) at the first rising edge 510 of the vertical clock signal CPV. Then, the gate driver 140 may detect the second rising edge 530 at which the vertical clock signal CPV rises from the first low periods T3 and T4 to the second high periods T5 and T6. Then, the gate driver 140 increases the first gate clock signal CK1 to a higher level and may reduce the first inverted gate clock signal CK1B to a lower level at the second rising edge 530 of the vertical clock signal CPV. That is, the first gate clock signal CK1 and the first inverted gate clock signal CK1B may be generated in synchronization with the rising edges 510, 530, 550, 570, and 590 of the vertical clock signal CPV.

According to an exemplary embodiment, as illustrated in FIG. 5, the first gate clock signal CK1 is reduced to an intermediate level at the first rising edge 510 of the vertical clock signal CPV and may be reduced to a low level after a predetermined 1-$1^{st}$ intermediate period T1. Then, the first gate clock signal CK1 is increased to an intermediate level at the second rising edge 530 of the vertical clock signal CPV and may be increased to a high level after a predetermined 1-$2^{nd}$ intermediate period T5. Likely, the first inverted gate clock signal CK1B is increased to an intermediate level at the first rising edge 510 of the vertical clock signal CPV and may be increased to a high level after the predetermined 1-$1^{st}$ intermediate period T1. Then, the first inverted gate clock signal CK1B is reduced to an intermediate level at the second rising edge 530 of the vertical clock signal CPV and may be reduced to a low level after the predetermined 1-$2^{nd}$ intermediate period T5. In an exemplary embodiment, a length of the 1-$1^{st}$ intermediate period T1 may be the same as that of the 1-$2^{nd}$ intermediate period T5. In this case, the 1-$1^{st}$ intermediate period T1 and the 1-$2^{nd}$ intermediate period T5 may be referred to as a first intermediate period. Values of the 1-$1^{st}$ intermediate period T1, the 1-$2^{nd}$ intermediate period T5, and the first intermediate period may be stored in a memory (not shown) of the gate driver 140.

In an exemplary embodiment, in the 1-$1^{st}$ intermediate period T1 and/or the 1-$2^{nd}$ intermediate period T5, charge share operation may be performed on the first gate clock signal CK1 and the first inverted gate clock signal CK1B. In an exemplary embodiment, as illustrated in FIG. 6, a first switch 610 may be provided between the output end of the first gate clock signal CK1 and the output end of the first inverted gate clock signal CK1B, for example. In an exemplary embodiment, when the rising edges of the vertical clock signal CPV are triggered, the first switch 610 is turned on so that the output end of the first gate clock signal CK1 and the output end of the first inverted gate clock signal CK1B may be shorted. Then, after the 1-$1^{st}$ intermediate period T1 and/or the 1-$2^{nd}$ intermediate period T5, the first switch 610 may be turned off. Therefore, in the 1-$1^{st}$ intermediate period T1 and/or the 1-$2^{nd}$ intermediate period T5, the intermediate level of the first gate clock signal CK1 and the intermediate level of the first inverted gate clock signal CK1B may have the same value.

The gate driver 140 may detect falling edges 520, 540, 560, and 580 of the vertical clock signal CPV. That is, the gate driver 140 may detect the falling edges 520, 540, 560, and 580 at which the voltage level of the vertical clock signal CPV changes from the high periods T1, T2, T5, T6, T9, and T10 of the vertical clock signal CPV to the low periods T0, T3, T4, T7, and T8 of the vertical clock signal CPV. Then, the gate driver 140 may generate the second gate clock signal CK2 and the second inverted gate clock signal CK2B using the falling edges 520, 540, 560, and 580 of the vertical clock signal CPV. In an exemplary embodiment, the second inverted gate clock signal CK2B has a phase opposite to that of the second gate clock signal CK2.

In an exemplary embodiment, in the $0^{th}$ low period T0 of the vertical clock signal CPV, the second gate clock signal CK2 is at a high level and the second inverted gate clock signal CK2B may be at a low level, for example. In an exemplary embodiment, the gate driver 140 may detect the first falling edge 520 at which the vertical clock signal CPV falls from the first high periods T1 and T2 to the first low periods T3 and T4. Then, the gate driver 140 reduces the second gate clock signal CK2 to a lower level and may increase the second inverted gate clock signal CK2B to a higher level at the first falling edge 520 of the vertical clock signal CPV. Then, the gate driver 140 may detect the second falling edge 540 at which the vertical clock signal CPV falls from the second high periods T5 and T6 to the second low periods T7 and T8. Then, the gate driver 140 increases the second gate clock signal CK2 to a higher level and may reduce the second inverted gate clock signal CK2B to a lower level at the second falling edge 540 of the vertical clock signal CPV. That is, the second gate clock signal CK2 and the second inverted gate clock signal CK2B may be generated in synchronization with the falling edges 520, 540, 560, and 580 of the vertical clock signal CPV.

According to an exemplary embodiment, as illustrated in FIG. 5, the second gate clock signal CK2 is reduced to an intermediate level at the first falling edge 520 of the vertical clock signal CPV and may be reduced to a low level after a predetermined 2-$1^{st}$ intermediate period T3. Then, the second gate clock signal CK2 is increased to an intermediate level at the second falling edge 540 of the vertical clock signal CPV and may be increased to a high level after a predetermined 2-$2^{nd}$ intermediate period T7. Likely, the second inverted gate clock signal CK2B is increased to an intermediate level at the first falling edge 520 of the vertical clock signal CPV and may be increased to a high level after the predetermined 2-$1^{st}$ intermediate period T3. Then, the second inverted gate clock signal CK2B is reduced to an intermediate level at the second falling edge 540 of the vertical clock signal CPV and may be reduced to a low level after the predetermined 2-$2^{nd}$ intermediate period T7. In an exemplary embodiment, a length of the 2-$1^{st}$ intermediate period T3 may be the same as that of the 2-$2^{nd}$ intermediate period T7. In this case, the 2-$1^{st}$ intermediate period T3 and the 2-$2^{nd}$ intermediate period T7 may be referred to as a second intermediate period. Values of the 2-$1^{st}$ intermediate period T3, the 2-$2^{nd}$ intermediate period T7, and the second intermediate period may be stored in the memory (not shown) of the gate driver 140. In addition, a length of the second intermediate period may be the same as that of the first intermediate period.

In an exemplary embodiment, in the 2-$1^{st}$ intermediate period T3 and/or the 2-$2^{nd}$ intermediate period T7, charge share operation may be performed on the second gate clock signal CK2 and the second inverted gate clock signal CK2B. In an exemplary embodiment, like the first switch 610 illustrated in FIG. 6 between the output end of the first gate clock signal CK1 and the output end of the first inverted gate clock signal CK1B, a second switch (not shown) may be provided between an output end of the second gate clock signal CK2 and an output end of the second inverted gate clock signal CK2B, for example. In an exemplary embodiment, when the falling edges of the vertical clock signal CPV are triggered, the second switch is turned on so that the output end of the second gate clock signal CK2 and the output end of the second inverted gate clock signal CK2B may be shorted. Then, after the 2-1$^{st}$ intermediate period T3 and/or the 2-2$^{nd}$ intermediate period T7, the second switch may be turned off. Therefore, in the 2-1$^{st}$ intermediate period T3 and/or the 2-2$^{nd}$ intermediate period T7, the intermediate level of the second gate clock signal CK2 and the intermediate level of the second inverted gate clock signal CK2B may have the same value.

As described above, in the display device according to the exemplary embodiment of the invention, the timing controller 120 generates only one vertical clock signal CPV having the rising edges 510, 530, 550, 570, and 590 and the falling edges 520, 540, 560, and 580 and may output the generated vertical clock signal CPV to the gate driver 140.

Then, the gate driver 140 receives the vertical clock signal CPV, detects the rising edges 510, 530, 550, 570, and 590 of the vertical clock signal CPV, and may generate the first gate clock signal CK1 and the first inverted gate clock signal CK1B. Then, the gate driver 140 detects the falling edges 520, 540, 560, and 580 of the vertical clock signal CPV and may generate the second gate clock signal CK2 and the second inverted gate clock signal CK2B.

In a conventional art, the timing controller 120 needs two output pins for transmitting the first vertical clock signal CPV1 and the second vertical clock signal CPV2 to the gate driver 140. However, according to the invention, since only one vertical clock signal CPV is to be transmitted, only one output pin is required so that the number of pins may be reduced by one. In addition, in a conventional art, the gate driver 140 needs two input pins for receiving the first vertical clock signal CPV1 and the second vertical clock signal CPV2. However, according to the invention, since only one vertical clock signal CPV is to be received, only one input pin is required so that the number of pins may be reduced by one.

According to the above embodiment, the gate driver 140 detects the rising edges 510, 530, 550, 570, and 590 of the vertical clock signal CPV, generates the first gate clock signal CK1 and the first inverted gate clock signal CK1B, detects the falling edges 520, 540, 560, and 580 of the vertical clock signal CPV, and generates the second gate clock signal CK2 and the second inverted gate clock signal CK2B. However, the invention is not limited thereto.

In an exemplary embodiment, referring to FIG. 7, the gate driver 140 may receive the vertical clock signal CPV having the high periods T0, T3, T4, T7, and T8 and the low period T1, T2, T5, T6, T9, and T10, for example. In an exemplary embodiment, the vertical clock signal CPV has falling edges 710, 730, 750, 770, and 790 at which a voltage level of the vertical clock signal CPV changes from the high periods T0, T3, T4, T7, and T8 and the low period T1, T2, T5, T6, T9, and T10 and may have rising edges 720, 740, 760, and 780 at which the voltage level of the vertical clock signal CPV changes from the low period T1, T2, T5, T6, T9, and T10 to the high periods T0, T3, T4, T7, and T8.

In this case, the gate driver 140 detects the falling edges 710, 730, 750, 770, and 790 of the vertical clock signal CPV and may generate the first gate clock signal CK1 and the first inverted gate clock signal CK1B. Then, the gate driver 140 senses the rising edges 720, 740, 760, and 780 of the vertical clock signal CPV and may generate the second gate clock signal CK2 and the second inverted gate clock signal CK2B.

That is, the gate driver 140 detects the falling edges 710, 730, 750, 770, and 790 of the vertical clock signal CPV and may generate the first gate clock signal CK1 and the first inverted gate clock signal CK1B. Then, the gate driver 140 senses the rising edges 720, 740, 760, and 780 of the vertical clock signal CPV and may generate the second gate clock signal CK2 and the second inverted gate clock signal CK2B.

That is, the gate driver 140 detects the falling edges 710, 730, 750, 770, and 790 of the vertical clock signal CPV, generates the first gate clock signal CK1 and the first inverted gate clock signal CK1B, senses the rising edges 720, 740, 760, and 780 of the vertical clock signal CPV, and may generate the second gate clock signal CK2 and the second inverted gate clock signal CK2B. Since detailed operation is similar to a method of generating the first gate clock signal CK1, the first inverted gate clock signal CK1B, the second gate clock signal CK2, and the second inverted gate clock signal CK2B, which is described in FIGS. 5 and 6, detailed description thereof will not be given.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the invention as set forth in the following claims.

What is claimed is:

1. A display device comprising:

a timing controller which transmits a vertical clock signal having rising edges and falling edges; and a gate driver which receives the vertical clock signal, generates a first gate clock signal and a first inverted gate clock signal in accordance with one of the rising edges and the falling edges of the vertical clock signal, and generates a second gate clock signal and a second inverted gate clock signal in accordance with a remaining one of the rising edges and the falling edges of the vertical clock signal.

2. The display device of claim 1, further comprising a display panel including a plurality of pixels, wherein the gate driver is combined with the display panel in a form of an amorphous silicon gate.

3. The display device of claim 1, wherein the first gate clock signal and the first inverted gate clock signal have opposite phases to each other, and wherein the second gate clock signal and the second inverted gate clock signal have opposite phases to each other.

4. The display device of claim 1, wherein the gate driver reduces a voltage level of the first gate clock signal to a lower level and increases a voltage level of the first inverted gate clock signal to a higher level at a first rising edge of the vertical clock signal and increases the voltage level of the first gate clock signal to a higher level and reduces the voltage level of the first inverted gate clock signal to a lower level at a second rising edge of the vertical clock signal.

5. The display device of claim 1, wherein the gate driver reduces a voltage level of the second gate clock signal to a lower level and increases a voltage level of the second inverted gate clock signal to a higher level at a first falling edge of the vertical clock signal and increases the voltage level of the second gate clock signal to a higher level and reduces the voltage level of the second inverted gate clock signal to a lower level at a second falling edge of the vertical clock signal.

6. The display device of claim 1, further comprising a data driver, wherein the data driver reduces a voltage level of the first gate clock signal or a voltage level of the second gate clock signal to an intermediate level at the first rising edge of the vertical clock signal, reduces the voltage level of the first gate clocks signal or the voltage level of the second gate clock signal to a low level after a predetermined first intermediate period, increases a voltage level of the first inverted gate clock signal or a voltage level of the second inverted gate clock signal to an intermediate level at the first rising edge, and increases the voltage level of the first inverted gate clock signal or the voltage level of the second inverted gate clock signal to a high level after the predetermined first intermediate period.

7. The display device of claim 6, wherein the data driver increases the voltage level of the first gate clock signal or the voltage level of the second gate clock signal to an intermediate level at the second rising edge of the vertical clock signal, increases the voltage level of the first gate clocks signal or the voltage level of the second gate clock signal to a high level after a predetermined second intermediate period, reduces the voltage level of the first inverted gate clock signal or the voltage level of the second inverted gate clock signal to an intermediate level at the second rising edge, and reduces the voltage level of the first inverted gate clock signal or the voltage level of the second inverted gate clock signal to a low level after the predetermined second intermediate period.

8. The display device of claim 7, wherein the gate driver includes an output end of the first gate clock signal and an output end of the first inverted gate clock signal shorted to perform charge share operation in one of the predetermined first intermediate period and the predetermined second intermediate period.

9. A method of driving a display device, the method comprising:

generating a vertical clock signal having rising edges and falling edges; and generating a gate clock signals, wherein the generating the gate clock signals comprises:

generating a first gate clock signal and a first inverted gate clock signal in accordance with one of the rising edges and the falling edges of the vertical clock signal; and generating a second gate clock signal and a second inverted gate clock signal in accordance with a remaining one of the rising edges and the falling edges of the vertical clock signal.

10. The method of claim 9, wherein the first gate clock signal and the first inverted gate clock signal have opposite phases to each other, and wherein the second gate clock signal and the second inverted gate clock signal have opposite phases to each other.

11. The method of claim 9, wherein the generating the gate clock signals further comprises:

reducing a voltage level of the first gate clock signal to a lower level and increasing a voltage level of the first inverted gate clock signal to a higher level at a first rising edge of the vertical clock signal; and increasing the voltage level of the first gate clock signal to a higher level and reducing the voltage level of the first inverted gate clock signal to a lower level at a second rising edge of the vertical clock signal.

12. The method of claim 9, wherein the generating the gate clock signals further comprises:

reducing a voltage level of the second gate clock signal to a lower level and increasing a voltage level of the second inverted gate clock signal to a higher level at a first falling edge of the vertical clock signal; and increasing the voltage level of the second gate clock signal to a higher level and reducing the voltage level of the second inverted gate clock signal to a lower level at a second falling edge of the vertical clock signal.

13. The method of claim 9, wherein the generating the gate clock signals further comprises:

reducing a voltage level of the first gate clock signal or a voltage level of the second gate clock signal to an intermediate level at the first rising edge of the vertical clock signal and reducing the voltage level of the first gate clock signal or the voltage level of the second gate clock signal to a low level after a predetermined first intermediate period; and increasing a voltage level of the first inverted gate clock signal or a voltage level of the second inverted gate clock signal to an intermediate level at the first rising edge and increasing the voltage level of the first inverted gate clock signal or the voltage level of the second inverted gate clock signal to a high level after the predetermined first intermediate period.

14. The method of claim 13, wherein the generating the gate clock signals further comprises:

increasing the voltage level of the first gate clock signal or the voltage level of the second gate clock signal to an intermediate level at the second rising edge of the vertical clock signal and increasing the voltage level of the first gate clocks signal or the voltage level of the second gate clock signal to a high level after a predetermined second intermediate period; and reducing the voltage level of the first inverted gate clock signal or the voltage level of the second inverted gate clock signal to an intermediate level at the second rising edge and reducing the voltage level of the first inverted gate clock signal or the voltage level of the second inverted gate clock signal to a low level after the predetermined second intermediate period.

15. The method of claim 14, wherein the generating the gate clock signals comprises having an output end of the first gate clock signal and an output end of the first inverted gate clock signal shorted to perform charge share operation in one of the predetermined first intermediate period and the predetermined second intermediate period.

* * * * *